United States Patent [19]

Dobbins et al.

[11] Patent Number: 4,936,282

[45] Date of Patent: Jun. 26, 1990

[54] GAS POWERED GUN

[76] Inventors: Jerrold M. Dobbins, 3320 Camino Calendria, Thousand Oaks, Calif. 91360; Ross Alexander, 20936 Puente Rd., Woodland Hills, Calif. 91364

[21] Appl. No.: 281,624

[22] Filed: Dec. 9, 1988

[51] Int. Cl.[5] ..... F41B 11/06

[52] U.S. Cl. ..... 124/74; 124/73

[58] Field of Search ..... 124/74, 73, 72, 76, 124/71, 75, 70, 56

[56] References Cited

U.S. PATENT DOCUMENTS

| | | | |
|---|---|---|---|
| 3,204,625 | 9/1965 | Shepherd | 124/74 |
| 3,572,310 | 3/1971 | Chiba | 124/74 |
| 3,695,246 | 10/1972 | Filippi et al. | 124/72 |
| 3,788,298 | 1/1974 | Hale | 124/76 |
| 4,344,410 | 8/1982 | Curran | 124/74 |
| 4,531,503 | 7/1985 | Shepherd | 124/76 |
| 4,819,609 | 4/1989 | Tippmann | 124/75 |

*Primary Examiner*—Randolph A. Reese
*Assistant Examiner*—John A. Ricci
*Attorney, Agent, or Firm*—Jack C. Munro

[57] ABSTRACT

A gas operated gun which is designed primarily to propel paint containing frangible projectiles. The gun can be designed to use a manually operable cocking mechanism which permits firing of a single projectile each time the cocking mechanism is operated. Also, the gun may be modified to include a valve mechanism which provides for automatic firing of the gun eliminating the need for the manually operated cocking.

3 Claims, 5 Drawing Sheets

GAS POWERED GUN

BACKGROUND OF THE INVENTION

The field of this invention relates to construction of guns and more particularly to a gun which is designed to propel a liquid containing a frangible projectile which is designed to break upon coming into contact with the intended target.

The use of marking guns is well-known. Within a marking gun there is employed a projectile which is generally in the shape of a marble. This projectile is constructed of a thin wall which is to readily break upon being propelled against a target. Typical construction for the wall of the projectile would be a gelatin. Within the wall of the projectile is contained a quantity of a liquid such as a colored paint. A typical color would be red.

In the past, it has been common to use marking guns in conjunction with wild animal management. These guns have been utilized to mark a single animal from a vehicle such as a jeep or a helicopter to assist the animal management person in counting of the wild animals, herding of the wild animals, or other similar desired procedures.

Within recent years, this type of a marking gun has begun to be used by human beings in other than animal management. The usage of this type of gun has to do with "war games" in which the human beings are divided into a plurality of groups. These groups are free to roam within a given geographical area and, upon one member of one group coming upon a member of another group, either member can fire a projectile at the other member. If one of the members become "hit" with a "paint ball", the hit member can now no longer continue to play the "game". The group that has the last remaining "surviving" member wins the game. It is to be understood that, normally, the paint ball does not cause injury to the human being. Although, it is possible that a bruise will result.

Within the prior art, the guns that have been designed to shoot these paint balls have been capable of only shooting one paint ball at a time with a manual cocking of the firing mechanism being required. There has not been known to utilize a valving mechanism which will permit semi-automatic firing of the paint balls which would eliminate the need for manual cocking of the gun to the firing position. Therefore, semi-automatic firing of a gun would permit a greater number of the paint balls to be fired within a short period of time.

SUMMARY OF THE INVENTION

The structure of the present invention provides for a first embodiment which includes a manually operated cocking mechanism. Manually cocking of the gun locates a paint ball within the bore of the barrel and also moves the trigger assembly to a "ready-to-fire" position. Operating of this trigger assembly causes a valve assembly within the gun to be opened permitting a quantity of a pressurized gas to be applied against the paint ball located within the bore of the barrel, hence, causing the paint ball to be propelled from the barrel at a rapid rate. Refiring of the gun requires that the cocking mechanism to again be operated. The second embodiment of this invention uses a similar type of gun construction with the exception that the valve mechanism is modified so that the pressurized gas will cause the cocking of the gun thereby eliminating the need for the manual cocking. This valve mechanism includes a gas storage chamber which is opened by the valve mechanism at an appropriate time to cause the gas to be propelled into the bore of the barrel and into contact with the paint ball located in the bore to propel such from the end of the barrel of the gun. This pressurized gas also causes the valve mechanism to again move to a cocking position which only requires manual activation of a trigger assembly to cause firing of the gun. Associated with the gun is a quick-disconnect mechanism for the gas cartridge which permits the gas cartridge to be readily changed when empty.

The primary objective of the present invention is to construct a paint ball propelling gun which can be operated more efficiently permitting more "rapid fire" deployment of the paint balls.

DETAILED DESCRIPTION OF THE SHOWN EMBODIMENT

Figures 1, 2, 8:
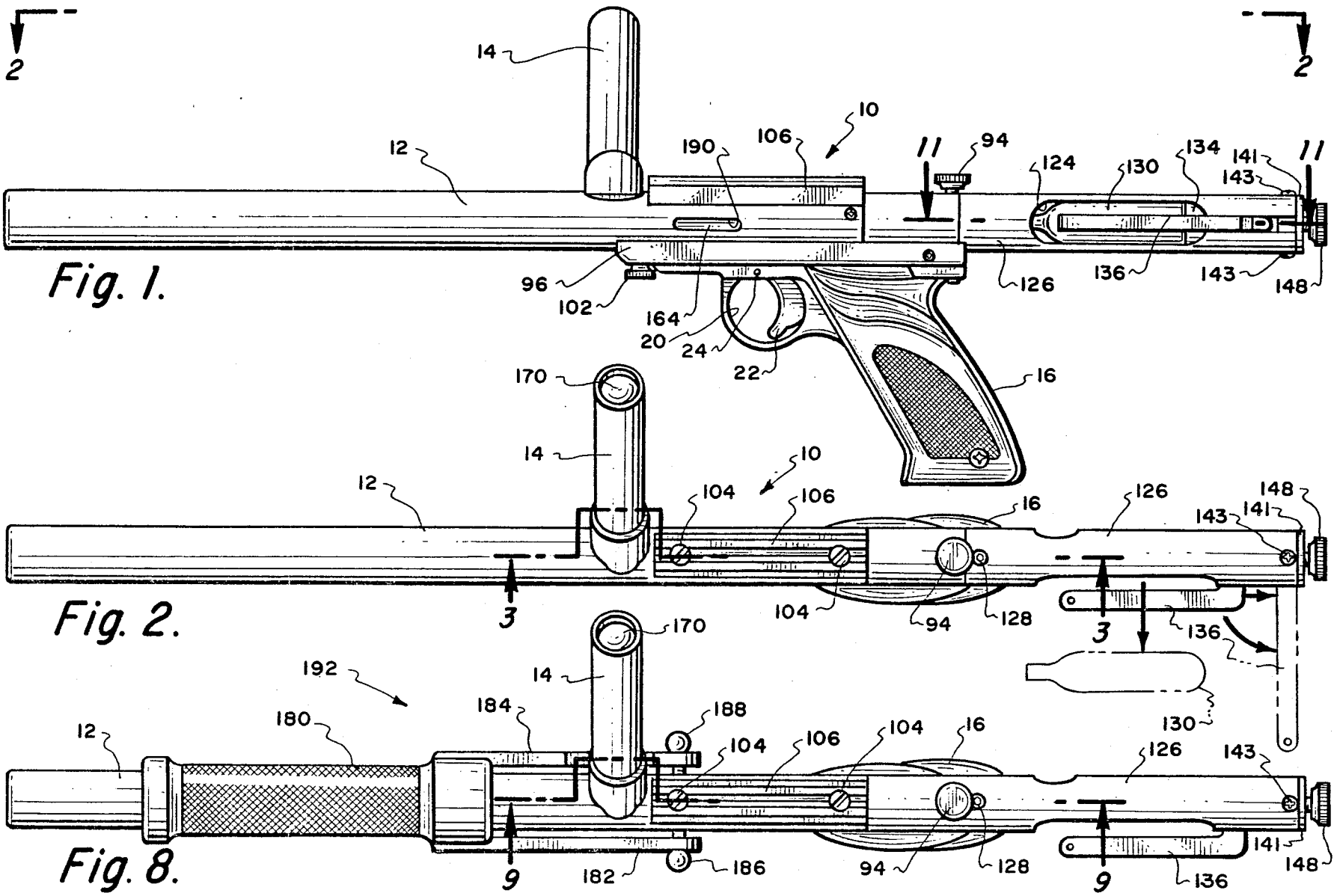
FIG. 1 is a side elevational view of one embodiment of the gun of the present invention which is designed for rapid firing of the paint balls.
FIG. 2 is a top plan elevational view of the gun of the present invention taken along line 2—2 of FIG. 1.
FIG. 8 is a view similar to that of FIG. 2 but of a further embodiment of the gun of this invention which utilizes a manual cocking of the valve mechanism as opposed to automatic cocking of the valve mechanism.

Referring particularly to the drawings, there is shown in FIGS. 1 through 7, the semi-automatic embodiment 10 of the gun of this invention. Broadly, the gun 10 includes a barrel 12, a magazine 14 and a pistol grip 16. Pistol grip 16 is basically a thin walled housing which will normally be constructed of a plastic or other similar type of material. Integral with the pistol grip 16 is a trigger guard 18. The trigger guard 18 defines an enclosed spaced 20. Mounted within the enclosed space 20 is a trigger 22. The trigger 22 is pivotally mounted by means of a pin 24 to a portion of the trigger guard 18. The trigger 22 is to be movable by a finger (not shown) of a human being from its normal at-rest position shown in FIG. 3 to a rearwardly displaced position shown in FIG. 4.

Figure 4:
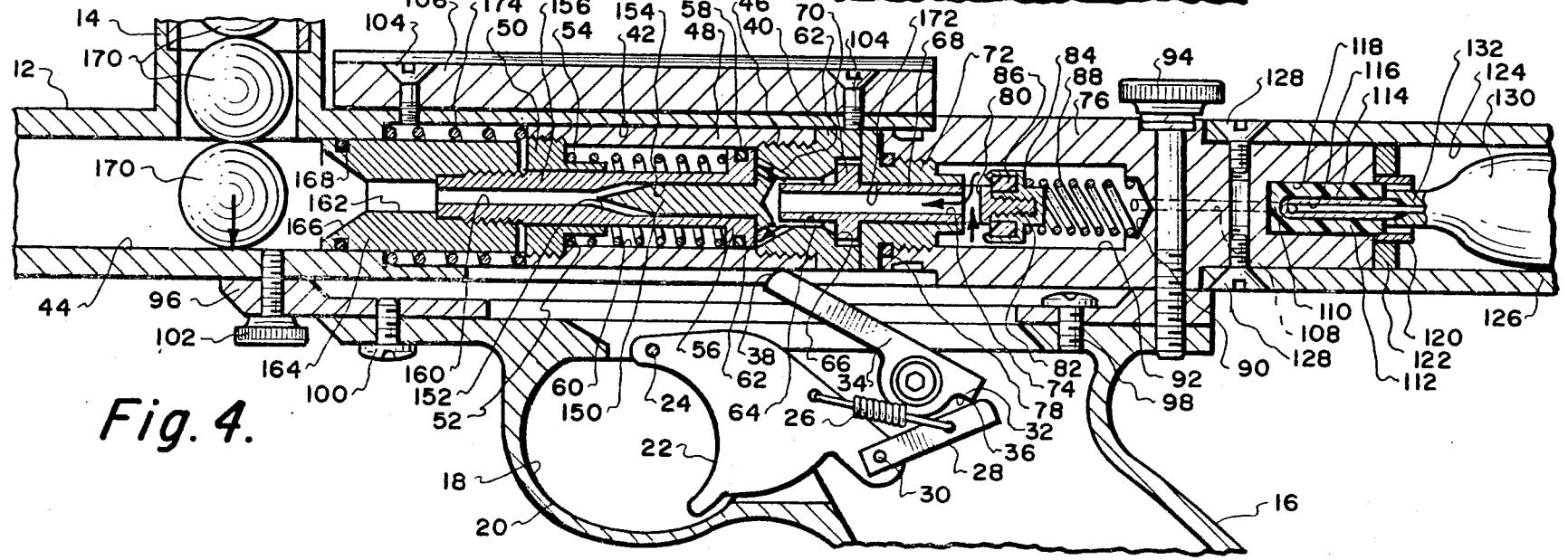
FIG. 4 is a view similar to FIG. 3 but showing the valve mechanism in an initially activated position with a paint ball being dispensed from the storage magazine into the bore of the barrel of the gun.
Figure 5:
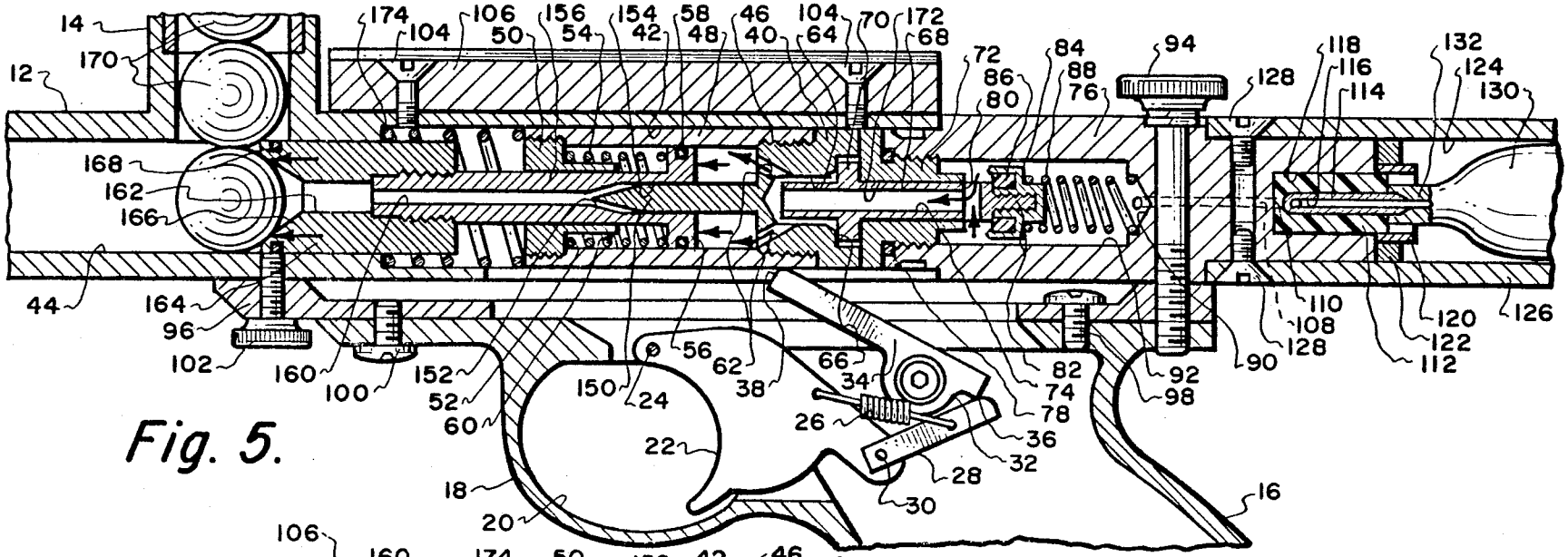
FIG. 5 is a view similar to FIG. 4 but showing of the valve mechanism in a position initially engaging with the paint ball that is to be propelled.
Figure 6:
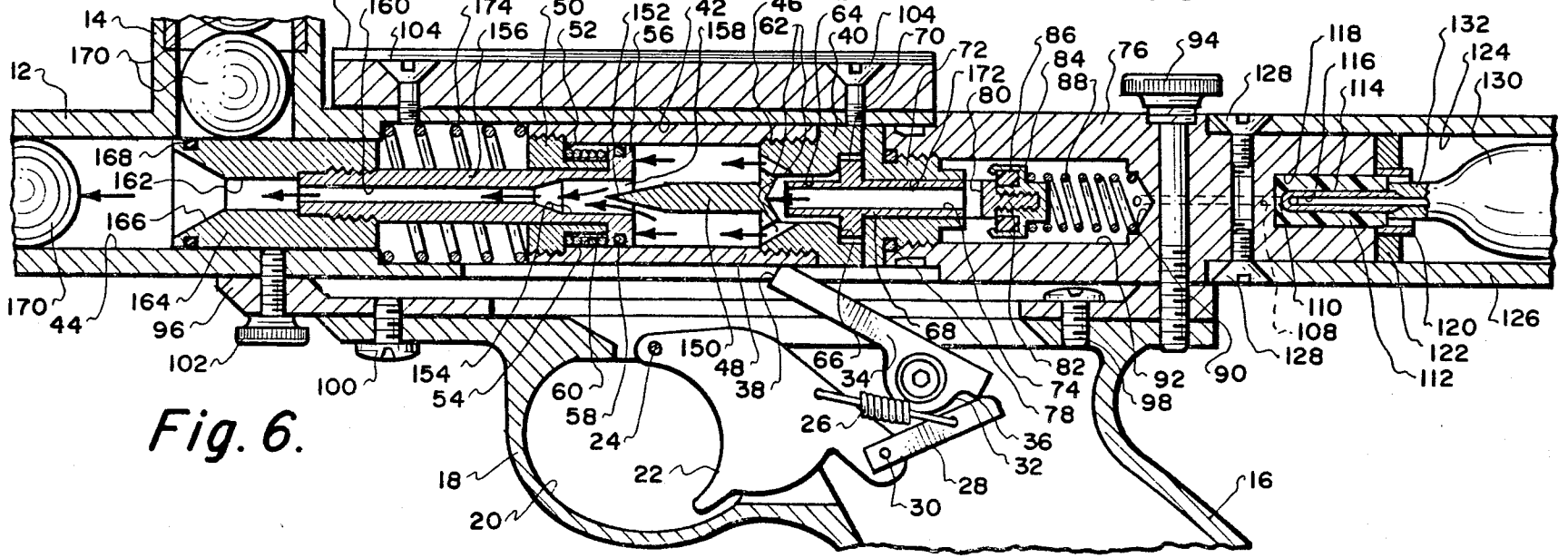
FIG. 6 is a view similar to FIG. 5 but showing the pressurized air now being applied against the paint ball to cause propelling of such exteriorly of the bore of the barrel of the gun.

Connected to the trigger 22 is one end of a spring 26. The opposite end of the spring 26 connects to a link 28. One end of the link 28 is pivotally mounted by a pin 30 to the trigger 22. The link 28 is under a continuous bias by the spring 26 to be located in the position shown in FIG. 3 of the drawings. In this position, the outer end of the link 28 rests within recess 32 of a sear 34. The wall of the recess 32 defines a shoulder 36. With the free end of the link 28 engaging with the recess 32 and held in that position by the bias of spring 26, the sear 34 is held in the position shown in FIGS. 3 and 7 of the drawings. Manual pressing of trigger 22 causes the free end of link 28 to press against the shoulder 36 causing pivoting of the sear 34 in a counterclockwise direction, such as shown in FIGS. 4 through 6 of the drawings.

Figure 3:
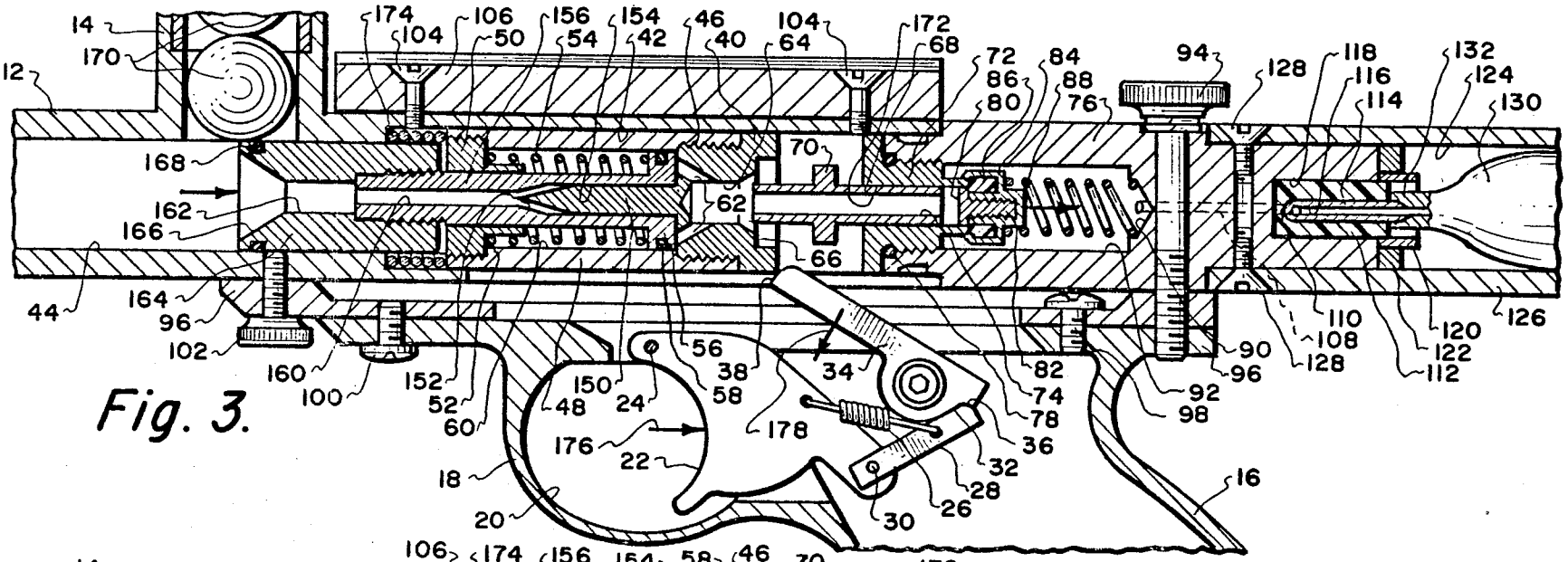
FIG. 3 is a cross-sectional view through the valve mechanism associated within the gun of the present invention taken along line 3—3 of FIG. 2 showing the valve mechanism in its at-rest position.
Figure 7:
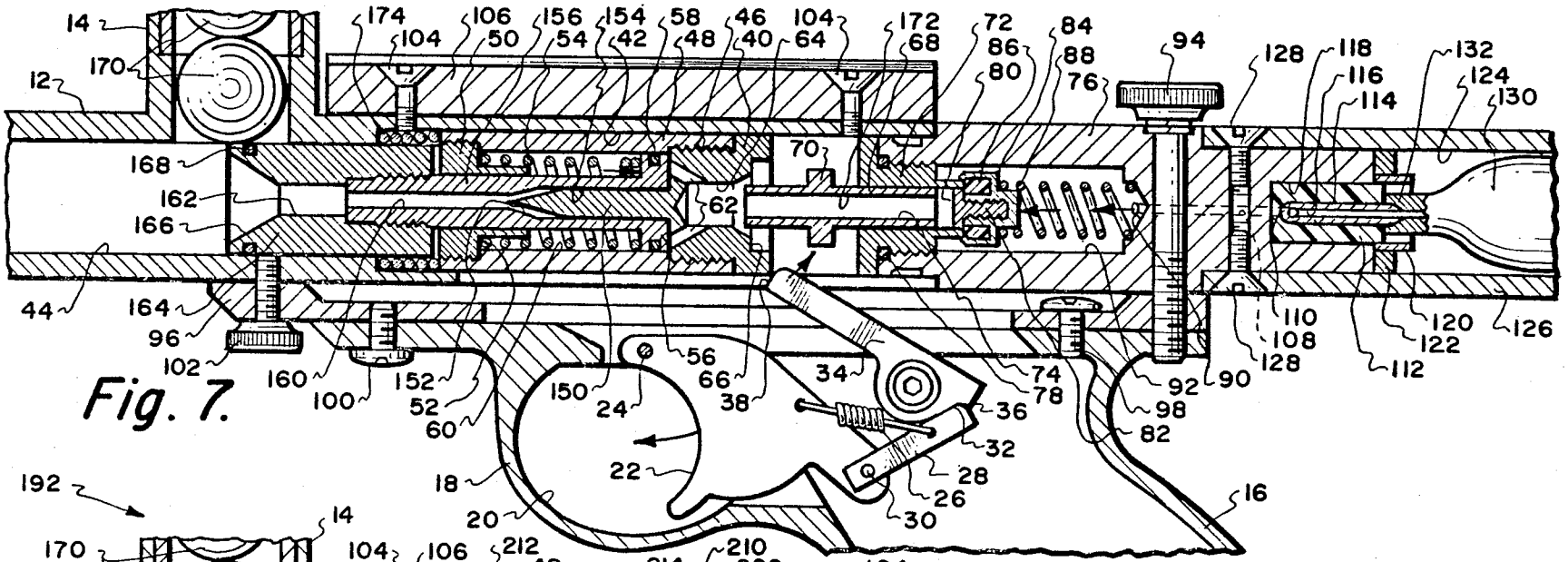
FIG. 7 is a view similar to FIG. 6 depicting automatic re-cocking of the gun which is in essence the position substantially identical to that of FIG. 3.

When the sear 34 is in the position shown in FIGS. 3 and 7, the outer end 38 of sear 34 abuts against a plug 40. Plug 40 is cylindrical and is movably mounted within an interior chamber 42. Interior chamber 42 is slightly larger in diameter than the bore 44 of the barrel 12. It is to be understood that the bore 44 is open at the outer free end of the barrel 12. It is also to be noted that the longitudinal center axis of the interior chamber 42 is in alignment with the longitudinal center axis of the bore 44.

The plug 40 has a smaller diametered section which includes a series of exterior screw threads 46. Threadably secured onto the threads 46 is one end of a sleeve 48. The forward end of the sleeve 48 is also threaded and is threadably secured to a disc 50. The backside of the disc 50 is formed into an annular recess 52 which functions as a retainer for one end of a coil spring 54. The opposite end of the spring 54 abuts against the inner wall of a piston 56. The piston 56 includes an O-ring seal 58 which forms a gas-tight seal with a through opening 60 centrally formed within the sleeve 48. The piston 56 is to be movable from a position directly adjacent the disc 50 to a position abutting against the plug 40. When the piston 56 abuts against the plug 40, the orifices 62 of the plug 50 are closed. The orifices 62 connect with enlarged passage 64 centrally formed within the plug 40. The enlarged passage 64 terminates at an annular shoulder 66 at the outer end of the plug 40.

The free outer end of a hollow rod 68 is to be locatable in a loose fitting manner within the enlarged passage 64. When so located, the annular enlarged protuberance 70, which is integral with the hollow rod 68, is to abut against the annular shoulder 66. The inner attached end of the rod 68 is fixedly mounted to annular plug 72. The rod 68 includes an elongated central through passage 74. The annular plug 72 includes a series of screw threads which are tightly secured within a body 76. Located between the body 76 and the plug 72 is an O-ring seal 78.

The rod 68 has a through opening 80 formed through its side wall. The outer end of the rod 68 terminates in a smaller diametered exteriorly threaded extension 82. Threadably mounted on the extension 82 is a seal housing 84. Mounted within the seal housing 84 is an annular rubber seal 86. Engaging with the exterior surface of the seal housing 84 is a coil spring 88. The opposite end of the coil spring 88 fits within an annular recess 90 of a gas storage chamber 92. This gas storage chamber 92 is formed within the body 76.

The body 76 is fixedly secured by means of a threaded fastener 94 to the pistol grip 16. Fastener 94 is also threadably secured to a plate 96 which is located between the body 76 and the pistol grip 16 and also between the barrel 12 and the trigger guard 18. The mounting plate 96 is mounted by fastener 98 to the pistol grip 16 and mounted by fastener 100 to the trigger guard 18. A separate fastener 102 secures together the plate 96 to the barrel 12.

Fixedly mounted by fasteners 104 to the upper surface of the barrel 12 and located rearwardly of the magazine 14 is a sight mount 106. The sight mount 106 is for the purpose of mounting thereon a sighting device such as a telescopic sight if such is deemed to be desired. Such a telescopic sight is not shown within the drawings.

Formed within the body 76 is a gas orifice 108. This orifice 108 connects with an orifice 110 formed within sealing member 112. Sealing member 112 is an open-ended hollow needle 114 mounted within the member 112 and protruding therefrom. The needle 114 has a centrally disposed passage 116. Sealing member 112 is fixedly mounted within elongated recess 118 with this fixing in place occurring, in part, by means of sleeve 120. Sleeve 120 is fixed to washer 122. The washer 122 is mounted within chamber 124 of a gas cartridge cover 126. This cover 126 is fixedly mounted by fasteners 128 to the body 76.

Located within the chamber 124 is a conventional gas cartridge 130. This gas cartridge 130 has a narrowed forward end which is sealed by penetratable sealing member 132. The cartridge 130 is to be located within the chamber 124 with the rounded outer end of the cartridge 130 resting within cup-shaped recess 133 of a cup member 134. When so locating of the cartridge 130 within the recess 133, the handle 136 is in the dotted line position shown in FIG. 2. This handle 136 is pivotally mounted by pivot pin 138 to a plug 140. Both the plug 140 and the cup member 134 are of the same diameter and are closely mounted within the chamber 124. Pivotally connected to one end of a link 142 by a pivot pin 144 is the cup member 134. The opposite end of the link 142 is pivotally mounted by pivot pin 146 to the handle 136.

With the handle 136 in the dotted line position shown in FIG. 2, the cup member 134 is moved within the chamber 124 to a position directly adjacent the plug 140. The rear end of the gas cartridge 130 can then be located within the recess 133 with the forward end of the gas cartridge 130 being positioned directly adjacent the needle 114. The operator then proceeds to move handle 136 to the solid line position shown in FIG. 2, which extends the cup member 134 from the plug 140. During this extending movement, the needle 114 penetrates through the penetratable seal 132 to be located within the confines of the gas cartridge 130. The gas within the gas cartridge 130 is then freely conductable through passage 116, orifice 108 and into gas storage chamber 92. This is the position shown in FIG. 3 of the drawings.

If it is desired to adjust the position of the gas cartridge 130 within the chamber 124, the operator only needs to turn threaded fastener 148 which pushes against the outermost surface of the plug 140 and moves such within the chamber 124. Fastener 148 is threadably mounted within plug 141 which is fixed by screws 143 to cover 126. It can thus be seen, by quick operation of the handle 136 that gas cartridge 130 can be readily removed from the chamber 124 and discarded when empty and replaced with a new gas cartridge 130 which is full of a pressurized gas. It is to be noted that the size of the orifice 108 is preselected so that the gas is seeped into the chamber 92. It will take approximately one-half a second in order to completely fill the chamber 92. This is desirable procedure to prevent emptying of the cartridge 130 in the making of a single firing of the gun 10.

Integral with the plug 40 and extending outwardly therefrom is a needle valve member 150 which has a sharp pointed outer end 152. This cylindrically shaped needle valve member 150 is closely mounted within hole 154 formed within piston 56. A portion of the hole 154 is located within piston extension 156 which is integral with the piston 56. The needle valve member 150 is capable of movement relative to the piston extension 156 but yet a substantially gas-tight seal is formed therebetween. However, when the piston 56 is moved sufficiently to completely compress the spring 54, there is a gap 158 formed between the forward edge of piston 56 and the sharp pointed outer end 152. The hole 154 connects with a narrowed-down passage 160. Passage 160 opens into centrally disposed opening 162 of a bolt 164. The bolt 164 is threadably secured to the piston extension 156.

Centrally disposed opening 162 connects to a flared passage 166 of the bolt 164. An O-ring seal 168 is formed within the exterior wall surface of the bolt 164. The function of the O-ring seal 168 is to maintain a substantially gas-tight connection between the bolt 164 and the bore 44.

The operation of the gun 10 is as follows: The magazine 14 is initially loaded with a plurality of paint balls 170 with these balls 170 being located in a stacked condition within the magazine 14. The outer end of the magazine 14 is open so that the balls 170 can be readily slipped therein. The lowermost paint ball 170 is to rest against the exterior surface of the bolt 164.

Referring particularly to FIG. 3, gas from the cartridge 130 is supplied into the gas storage chamber 92. However, the seal 86 abuts against a portion of the plug 72 and forms a seal therebetween with through opening 80 being sealed off by the wall of hole 172 of the plug 72. Therefore, the conducting of any gas into passage 74 is prevented. The end 38 of the sear 34 abuts against the forward edge of the plug 40 preventing movement of the plug 40 within the chamber 42. It is to be noted that spring 174 is completely compressed with one end of the spring 174 resting against a portion of the barrel 12 and the opposite end of the spring 174 resting against sleeve 48.

The operator then proceeds to apply a manual force against trigger 22 in the direction of arrow 176. Link 28 pushes against shoulder 36 causing the sear 34 to be pivoted a small amount in the direction of arrow 178. As a result, plug 40 is moved within chamber 42 by the expanding of spring 174. This movement continues to occur until the annular shoulder 66 contacts enlarged protuberance 70 and further movement of the plug 40 continues until plug 40 comes into contact with plug 72. At this time, the through opening 80 is exposed to the chamber 92 and the pressurized gas within the chamber 92 is conducted into passage 74 through orifices 62 against the piston 56. The action of the spring 174 has moved the sleeve 48 sufficiently and the bolt 164 sufficiently to permit the paint ball 170 that is lowest in the stack in the magazine 14 to fall within the bore 44. It is to be noted that the end 38 of the sear 34 is in contact with a portion of the side wall of the sleeve 48 and will remain in that position even if the pressure being applied against the trigger 22 is released.

The gas pressure causes the piston 56 to move with the paint ball 170 that is located within the bore 44 being moved within the flared passage 166 of the bolt 164. The gas pressure continues to cause the piston 56 to move until finally the bolt 164 completely closes off the magazine 14. At this particular time, the forward edge of the piston 56 exposes gap 158. The pressurized gas can then pass through the gap 158 into hole 154, narrowed down passage 160, centrally disposed opening 162 and out through flared passage 166 into bore 44. This gas pressure is applied directly against the ball 170 that is located within the bore 44 and causes such to be propelled exteriorly of the barrel 12.

Sufficient momentum is created in the moving of the piston 56 to not only compress the spring 54 but cause the sleeve 48 and disc 50 to be moved within the chamber 42 to compress spring 174. When the spring 174 is completely compressed, the sear 34 becomes free to move a slight distance clockwise until the outer end 38 again abuts against the forward end of the plug 40. At this time, through opening 80 is no longer exposed to the chamber 92 so that the chamber 92 is now again completely closed and permitted to be recharged with pressurized gas from the cartridge 130. Now the valve mechanism within the gun 10 of this invention is returned to the position in FIG. 3 with firing of another paint ball 170 to occur by merely depressing of the trigger 22.

Figure 9:
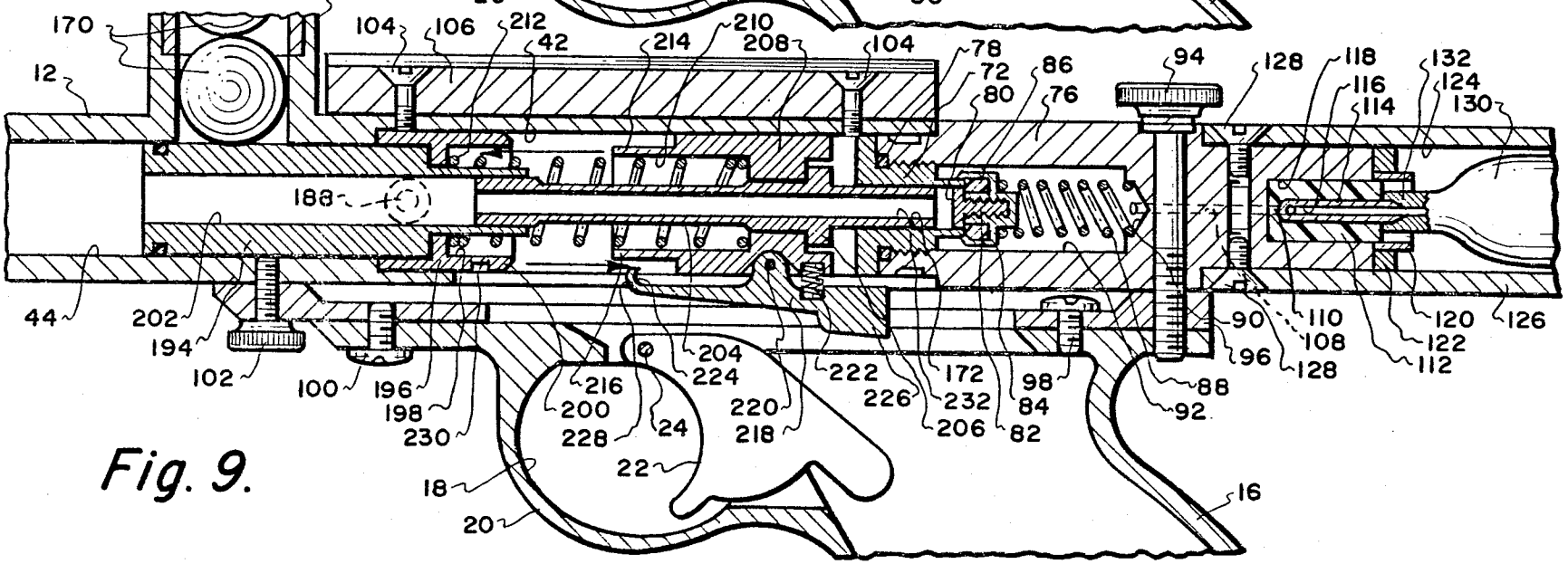
FIG. 9 is a cross-sectional view through the valve mechanism included within the second embodiment of this invention taken along line 9—9 of FIG. 8 putting the valve mechanism in an at-rest position.

Reference now is to be had to FIGS. 8 and 9 of the drawings in which there is shown a second embodiment of this invention which utilizes a cocking mechanism in the form of a sleeve 180 which is mounted on the exterior surface of the barrel 12. Like numerals, which are to refer to like parts, when comparing the embodiments of FIGS. 8 and 9 to FIGS. 1 and 7, that have been used in the discussion within FIGS. 1 through 7, are deemed to be also applicable to the parts within FIGS. 8 and 9. The second embodiment of this invention will be discussed only as to its differentness in structure than that of FIGS. 1 through 7.

The sleeve 180 is manually graspable and movable in a rearward direction, that is, toward magazine 14. The rear end of the sleeve 180 is bifurcated forming legs 182 and 184. The outer end of leg 182 is connected to a pin 186. The outer end of the leg 184 is connected to a pin 188. Pin 186 passes through a slot 190 formed within the barrel 12. In referring to FIG. 1, slot 190 is shown. However, the slot 190 has no use within the embodiments of FIGS. 1 through 7 and it could be closed off. However, it is to be remembered that the cocking mechanism within FIGS. 8 and 9 could be eliminated and the valving mechanism changed to the valving mechanism in FIGS. 1 through 7 thereby making the manually operational cocking gun 192 of FIGS. 8 and 9 into a semi-automatic gun as shown in FIGS. 1 through 7. The slot 190 would remain.

It is to be understood that the pin 188 is to be conducted through a slot (not shown) similar to slot 190 located diametrically opposite slot 190 on the barrel 12. Both pins 186 and 188 are fixedly secured to the bolt 194. The bolt 194 is essentially identical to bolt 164 with the exception that it is longer in length. It is to be understood that the outer end of the bolt 194 is to come into contact with a paint ball 170 that is located within the bore 44. The inner end of the bolt 194 has fixedly mounted thereon a sleeve 196. Sleeve 196 is slidingly movable within the chamber 42 of the barrel 12. The sleeve 196 includes an annular recess 198. The forward edge of the sleeve 196 is formed into a chamber which is to function as a cam surface 200.

The bolt 194 includes a longitudinal through opening 202. Within this through opening 202 is slidingly located rod 204. Rod 204 is essentially similar to rod 68 with the exception that it is longer in length. Rod 204 has an exterior annular protuberance 206 which is also similar to enlarged protuberance 70 of rod 68. The opposite end of the rod 204 is located within through opening 172 of plug 72.

Located against the annular protuberance 206 is sleeve 208. Sleeve 208 defines an annular recess 210 within which is located one end of a coil spring 212. The opposite end of the coil spring 212 is located within annular recess 198 and abuts against the sleeve 196. The forward edge of the sleeve 208 is formed into a thin annular extension 214.

The sleeve 208 includes an elongated groove 216. Groove 216 will normally be narrow in width, such as approximately one-eighth to one-quarter of an inch. Mounted within a portion of the groove 216 is a pawl 218. The pawl 218 is pivotally mounted to the sleeve 208 by means of a pin 220 with this pin 220 extending across the groove 216.

Located between the sleeve 208 and the aft end of the pawl 218 is a coil spring 222. The bias of the coil spring 222 is to tend to locate the hook member 224 of the pawl 218 into contact with the annular extension 214. The aft end of the pawl 218 is formed into an actuating member 226. The exterior surface of the hook member 224 is inclined forming a cam surface 228.

Let it be assumed the second embodiment (cocking gun 192) of this invention is in the position as shown in FIG. 9 of the drawings. Let it now be assumed that the operator wishes to place a paint ball 170 within the bore 44 and fire such in the barrel 12. In order to accomplish this, the user manually grasps sleeve 180 and moves such toward magazine 14 while holding of the pistol grip 16. This manual movement is limited by the length of slot 190. With the bolt 194 in the position closest to magazine 14, the ball 170, that is lowest in the stack, is able to fall into the bore 44. At the same time, the annular extension 214 moves within the annular recess 198 along with one end of the spring 212 which is already located within the recess 198. The cam surfaces 200 and 228 ride on one another until hook member 224 falls within slot 230 of the sleeve 196. At this time, the sleeves 196 and 208 are connected together. The pawl 218 has pivoted slightly compressing spring 222. Annular protuberance 206 abuts against sleeve 208 but no movement of rod 204 has occurred compressing spring 88.

Figure 10:
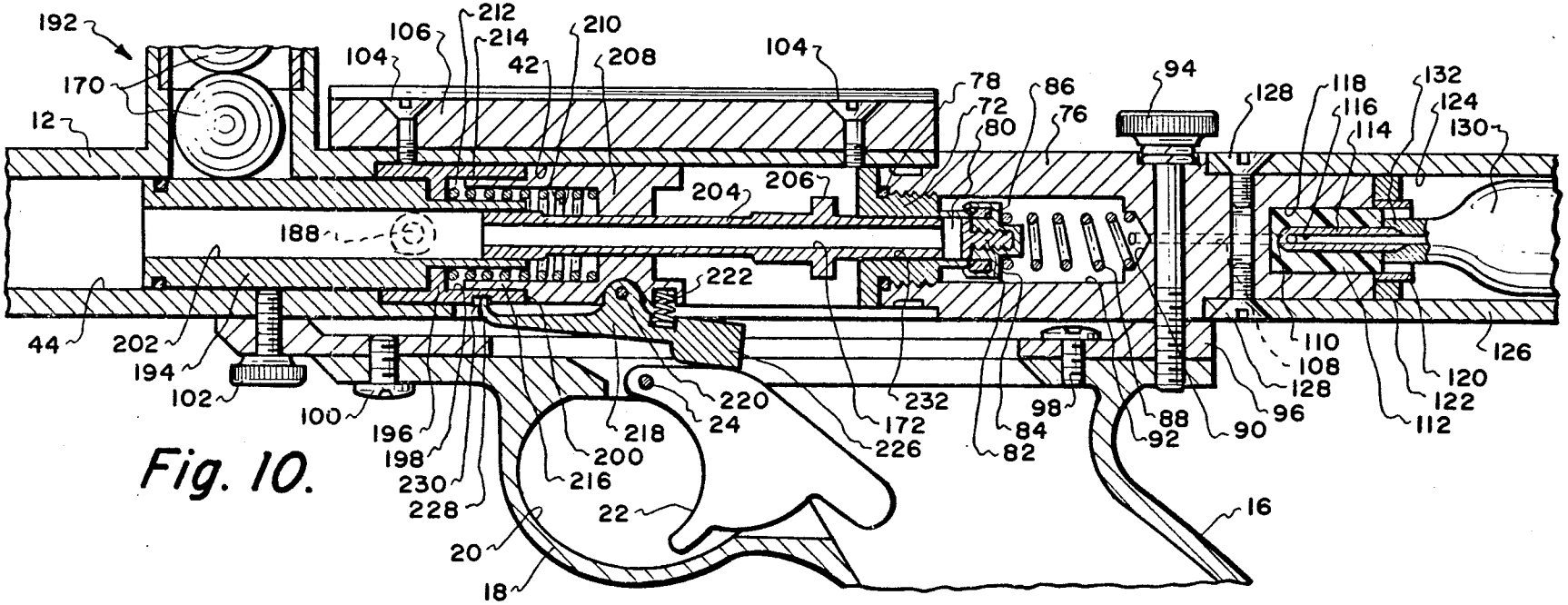
FIG. 10 is a cross-sectional view, similar to FIG. 9, showing the valve mechanism in the cocked position.
Figure 11:
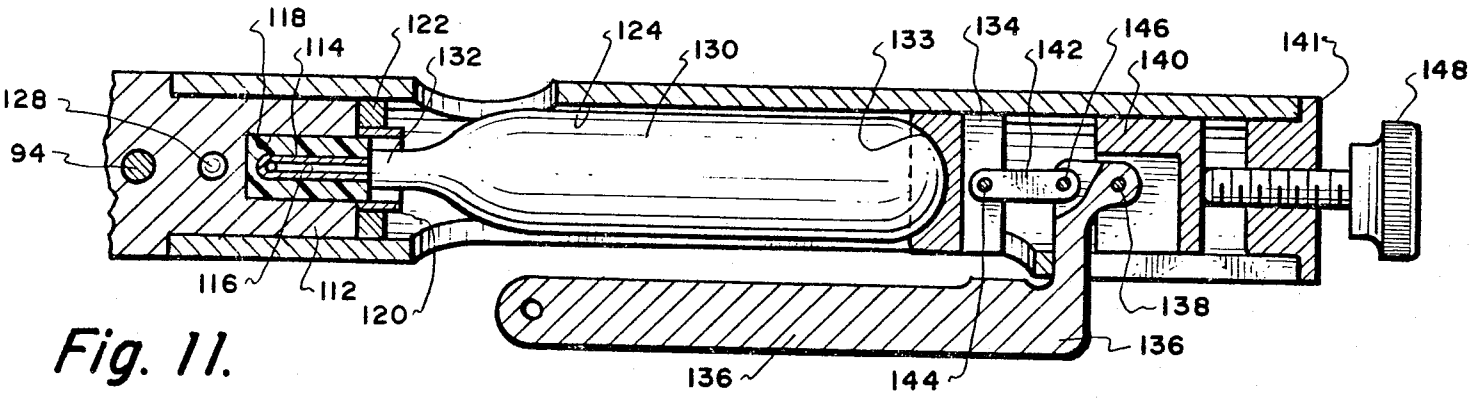
FIG. 11 is a cross-sectional view through the gas storage chamber arrangement taken along line 11—11 of FIG. 1.

The operator then proceeds to move sleeve 180 forwardly, back to the position shown in FIG. 8 of the drawings. During this movement, the bolt 194 is moved to the position shown in FIG. 10 with therebeing a paint ball 170 located within the bore 44 against the forward edge of the bolt 194. The spring 212 is compressed. Sleeve 208 is moved some spaced distance from the annular protuberance 206 with the actuating member 226 being located directly against the upper surface of the trigger 22.

When the operator squeezes the trigger 22, the actuating member 226 is moved toward rod 204 until hook member 224 disengages from the slot 230. At this time, the bias of the spring 212 causes the sleeve 208 to move away from the sleeve 196 until the sleeve 208 comes into contact with the annular protuberance 206 and moves such against the bias of spring 88 until sleeve 208 comes against plug 72. At this particular time the through opening 80 connects with the gas storage chamber 92 which causes the pressurized gas within the chamber 92 to be conducted into through opening 80, through passage 232 of the rod 204, through longitudinal through opening 202, and into bore 44 against the paint ball 170 located therein. The emptying of the gas from the chamber 92 occurs very quickly which is sufficient to cause the paint ball 170 to be rapidly propelled from the barrel 12.

In actual practice, the sleeve 208 will be moved by momentum against the plug 72 and then return to the position shown in FIG. 9 of the drawings. That movement, which is just momentary, is sufficient to cause the gas contained within the chamber 92 to propel the paint ball 170 from the barrel 12. At this particular time, the embodiment of the gun shown in FIG. 9 is now in the position to be recocked with another paint ball 170 to be fired therefrom.

What is claimed is:

1. A gun comprising:

a barrel, said barrel having a bore;

a projectile storage magazine mounted on said barrel, a plurality of paint ball projectiles located within said projectile storage magazine, a said projectile to be discharged from said bore of said barrel;

a manually operational trigger assembly connected to said barrel;

a projectile propelling mechanism connected to said barrel and said trigger assembly, manual operation of said trigger assembly causes activation of said projectile propelling mechanism, resulting in discharging of said projectile from said bore of said barrel, said projectile propelling mechanism comprising:

a pressurized gas cylinder assembly mounted on said barrel, said pressurized gas cylinder assembly including a gas cartridge which contains a pressurized gas;

a valve mechanism mounted within said barrel connecting with said bore, said valve mechanism having a gas passage arrangement connecting said gas cartridge and said bore, said valve mechanism having an at-rest position preventing movement of a said projectile into said bore and also locates said gas passage arrangement in a closed position, said valve mechanism being connected to said trigger assembly, operation of said trigger assembly causes said valve mechanism to move to a rear position permitting a said projectile to enter said bore and said gas passage arrangement to be opened permitting the pressurized gas from said gas cartridge to be supplied against the said projectile located in said bore causing propelling of such exteriorly of said barrel after which said valve mechanism returns to said at-rest position; and said valve mechanism including a first gas storage chamber and a second gas storage chamber, said gas cartridge being in continuous engagement with said first gas storage chamber filling said first gas storage chamber with pressurized gas, a piston movably mounted within said second gas storage chamber, said piston directly connecting with the said projectile to be discharged, a first normally closed valve located between said first gas storage chamber and said second gas storage chamber, opening of said first normally closed valve causes pressurized gas to flow from said first gas storage chamber to said second gas storage chamber, said piston being mounted within a sleeve, said sleeve connecting a spaced apart disc and a plug, said sleeve and said disc and said plug being movably mounted within a chamber formed within said valve mechanism, said second gas storage chamber being located within said sleeve, a second normally closed valve located between said bore and said second gas storage chamber, opening of said second normally closed valve causes flow of the pressurized gas into said bore and discharge of the said projectile.

2. The gun as defined in claim 1 wherein:

said pressurized gas cylinder assembly including a handle, said handle being manually movable between an engaged position and a disengaged position, with said handle in said disengaged position said gas cartridge being readily removable and replaceable from said pressurized gas cylinder assembly, with said handle in said engaged position said gas cartridge being securely held within said pressurized gas cylinder assembly.

3. The gun as defined in claim 1 wherein:

said barrel having a front end and a rear end, said pressurized gas cylinder assembly being mounted on said rear end, said rear position being when said valve mechanism moves towards said rear end.

* * * * *